US007849578B2

(12) United States Patent
Ying

(10) Patent No.: US 7,849,578 B2
(45) Date of Patent: Dec. 14, 2010

(54) PROGRESSIVE AND TRANSFER DIE STAMPING

(75) Inventor: Law Kung Ying, Singapore (SG)

(73) Assignee: Cheung Woh Technologies, Ltd., Singapore (SG)

( * ) Notice: Subject to any disclaimer, the term of this patent is extended or adjusted under 35 U.S.C. 154(b) by 0 days.

(21) Appl. No.: 12/455,090

(22) Filed: May 27, 2009

(65) Prior Publication Data

US 2009/0235517 A1 Sep. 24, 2009

Related U.S. Application Data

(62) Division of application No. 10/864,793, filed on Jun. 8, 2004, now Pat. No. 7,546,669.

(51) Int. Cl.
*B21D 39/03* (2006.01)
*B23P 13/04* (2006.01)

(52) U.S. Cl. ..... 29/430; 29/557

(58) Field of Classification Search ..... 29/557, 29/430, 429, 428, 603.63, 413; 360/97.01, 360/99.08, 265.6; 72/379.2; 413/17
See application file for complete search history.

(56) References Cited

U.S. PATENT DOCUMENTS

| | | | |
|---|---|---|---|
| 3,860,803 | A | 1/1975 | Levine |
| 4,023,313 | A | 5/1977 | LeBlanc |
| 4,106,422 | A | 8/1978 | Buhrke |
| 4,651,773 | A | 3/1987 | Takahashi et al. |
| 4,785,523 | A | 11/1988 | Koseki et al. |
| 4,821,403 | A | 4/1989 | Rolland et al. |
| 5,034,837 | A | 7/1991 | Schmitz |
| 5,047,604 | A | 9/1991 | Grass et al. |
| 5,313,124 | A | 5/1994 | Macpherson |
| 5,347,888 | A | 9/1994 | Yoshino et al. |
| 5,417,097 | A | 5/1995 | Kojima et al. |
| 5,584,202 | A | 12/1996 | Kanamaru et al. |
| 5,587,856 | A | 12/1996 | Aoyama |
| 5,602,700 | A | 2/1997 | Viskochil et al. |
| 5,624,319 | A | 4/1997 | Golczyk et al. |

(Continued)

FOREIGN PATENT DOCUMENTS

JP 58077720 A 5/1983

(Continued)

OTHER PUBLICATIONS

Aluminum Extrusion Industries (AEI) Brochure, "Quality That Always Shines Through," 3 pages (Prior to Aug. 16, 2000).

(Continued)

*Primary Examiner*—John C Hong
(74) *Attorney, Agent, or Firm*—Blakely, Sokoloff, Taylor & Zafman LLP

(57) ABSTRACT

Numerous embodiments of a method to form a base plate for a hard disk drive are described. In one embodiment, a blank base plate is advanced through plurality of die stations and parts of the base plate are press worked to form a disk drive base plate. In one embodiment, the blank base plate may be press worked by stamping the base plate with a progressive die assembly. In an alternative embodiment, the blank base plate may be press worked by stamping the base plate with a transfer die assembly.

13 Claims, 18 Drawing Sheets

U.S. PATENT DOCUMENTS

| | | | |
|---|---|---|---|
| 5,765,275 | A | 6/1998 | Obara |
| 5,906,083 | A | 5/1999 | Olsen et al. |
| 5,941,113 | A | 8/1999 | Kanemitsu et al. |
| 5,966,976 | A | 10/1999 | Haraga |
| 6,018,977 | A | 2/2000 | Kanno et al. |
| 6,023,392 | A | 2/2000 | Kim |
| 6,063,508 | A | 5/2000 | Hanrahan et al. |
| 6,075,695 | A | 6/2000 | Konno et al. |
| 6,084,750 | A | 7/2000 | Shimazu et al. |
| 6,178,061 | B1 | 1/2001 | Obara |
| 6,191,921 | B1 | 2/2001 | Hanrahan et al. |
| 6,227,029 | B1 | 5/2001 | Stanley |
| 6,275,353 | B1 | 8/2001 | Briggs |
| 6,307,713 | B1 | 10/2001 | Miyata et al. |
| 6,327,151 | B1 | 12/2001 | Chen et al. |
| 6,337,782 | B1 | 1/2002 | Guerin et al. |
| 6,382,064 | B1 | 5/2002 | Dugger |
| 6,389,869 | B1 | 5/2002 | Wakita et al. |
| 6,397,651 | B2 | 6/2002 | Usui et al. |
| 6,402,009 | B1 | 6/2002 | Ishikawa |
| 6,411,581 | B1 | 6/2002 | Saitou et al. |
| 6,426,847 | B1 | 7/2002 | Dague et al. |
| 6,427,317 | B1 | 8/2002 | Choi |
| 6,430,799 | B1 | 8/2002 | Ballard et al. |
| 6,542,459 | B2 | 4/2003 | Miyazaki et al. |
| 6,608,732 | B2 | 8/2003 | Bernett et al. |
| 6,982,850 | B1 | 1/2006 | Ying |
| 7,146,713 | B1 | 12/2006 | Ying |
| 7,546,669 | B1 | 6/2009 | Ying |

FOREIGN PATENT DOCUMENTS

| | | | |
|---|---|---|---|
| JP | 63036932 | A | 2/1988 |
| JP | 5-94668 | A | 4/1993 |
| JP | 05123755 | A | 5/1993 |
| JP | 8-153386 | A | 6/1996 |
| JP | 9-120669 | A | 5/1997 |

OTHER PUBLICATIONS

Japanese Standards Association, "JIS Handbook 1986: Non-Ferrous Metals and Metallurgy," pp. 605, 608, 611, 613, 617, and 639-641 (1986).

Aida Press Handbook (Third Edition) by Aida Engineering, Ltd., pp. 21-29, 52-55, 63, 65, 391-394, 398-400, and 449 (1992).

The E Coating Process Overview, Jan. 2, 1998.

New Leveler Feeder 300-E/300-R, AIDA Brochure, 2 pages. (Prior to Aug. 16, 2000).

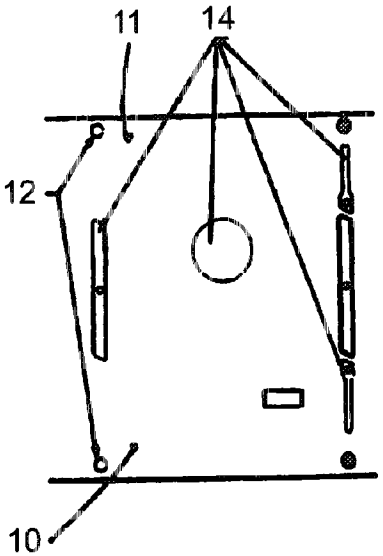
FIG. 1
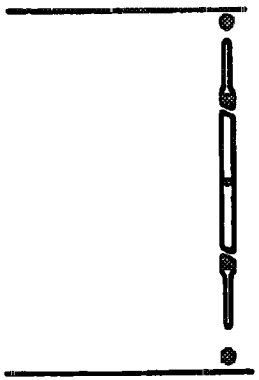
FIG. 2
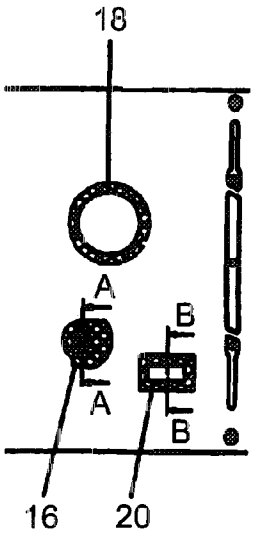
FIG. 3
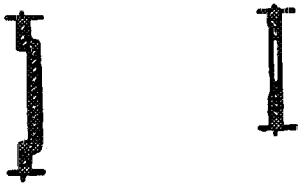
SECTION A–A
FIG. 4
SECTION B–B
FIG. 5

SECTION D–D

SECTION C–C

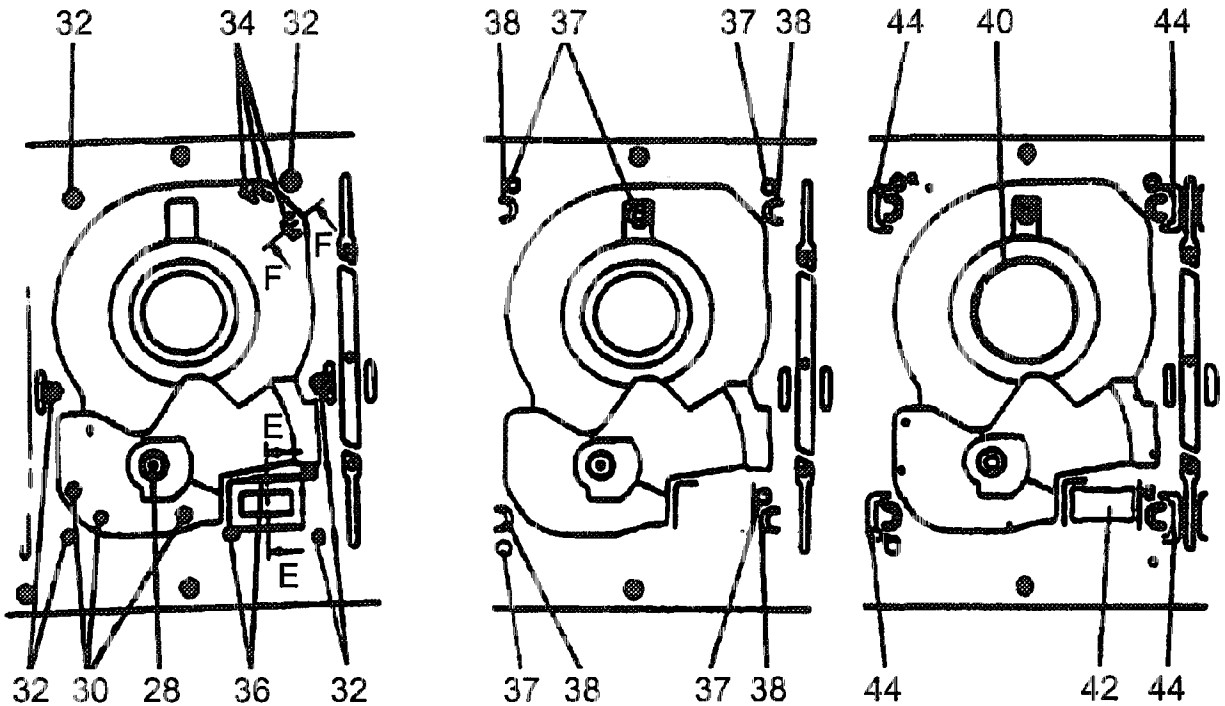
FIG. 11
FIG. 14
FIG. 15
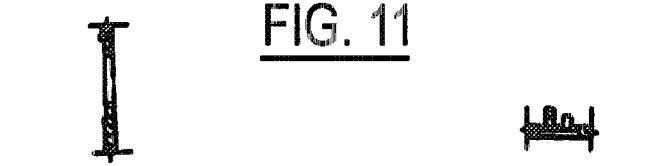
SECTION E–E
FIG. 12
SECTION F–F
FIG. 13

SECTION C–C

SECTION E–E

SECTION D–D

SECTION F–F

SECTION G–G

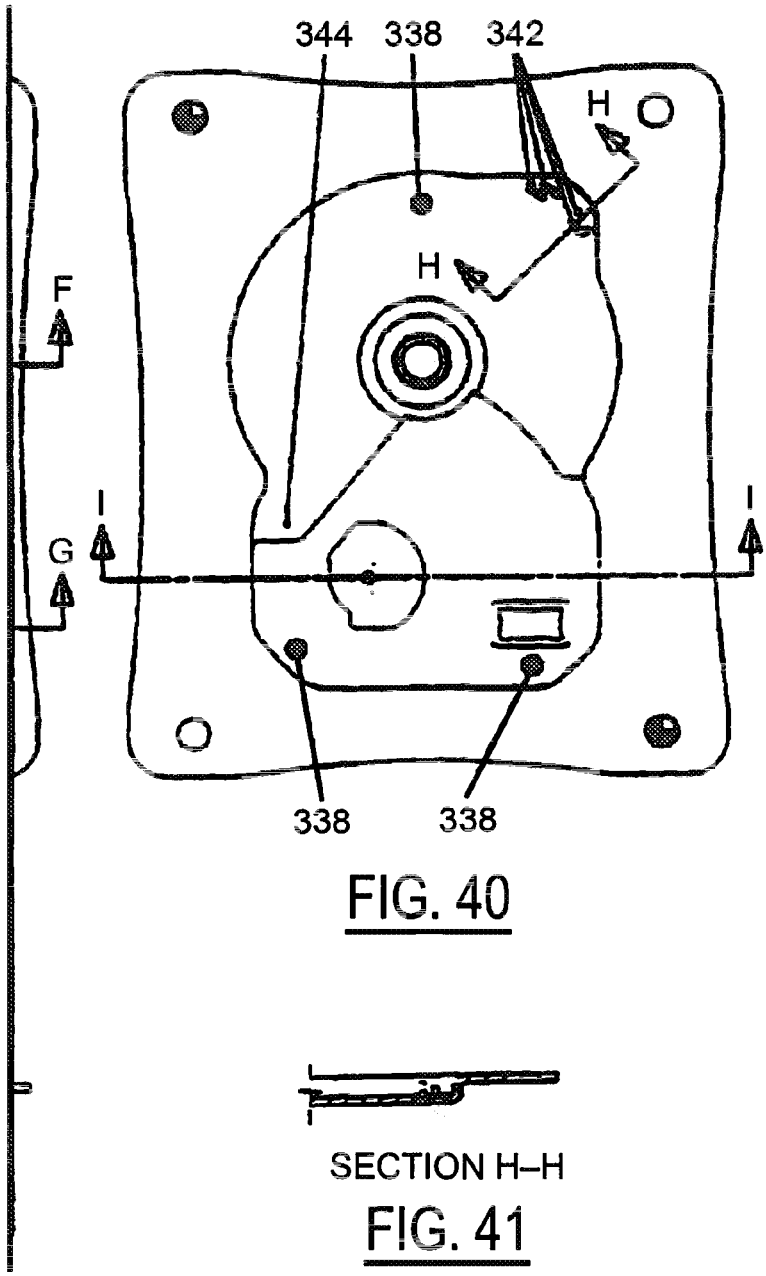
FIG. 40
SECTION H–H
FIG. 41
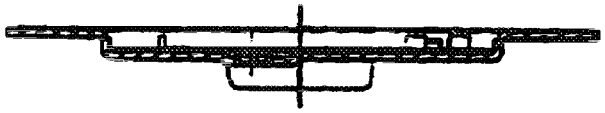
SECTION I–I
FIG. 42

SECTION J–J

SECTION E–E

PROGRESSIVE AND TRANSFER DIE STAMPING

CROSS REFERENCE TO RELATED APPLICATION

The present application claims priority from and is a divisional application of U.S. patent application Ser. No. 10/864,793, filed Jun. 8, 2004 now U.S. Pat. No. 7,546,669. The present application is also related to the following patent applications: (1) U.S. patent application Ser. No. 09/640,472, filed Aug. 16, 2000, entitled "Method of Manufacturing a Base Plate", which issued as U.S. Pat. No. 7,146,713 B1; and (2) U.S. patent application Ser. No. 10/431,144 filed May 6, 2003, entitled "Method of Manufacturing a Base Plate", which issued as U.S. Pat. No. 6,982,850 B1, which is a divisional of U.S. Pat. No. 7,146,713 B1.

FIELD

Embodiments of the present invention relate generally to the field of manufacturing metal parts and more specifically, a manufacturing process for forming a base plate for a hard disk drive.

BACKGROUND

The housing of hard disk drives for use in computer systems typically include a cover and a base plate attached with screws. Base plates support the hard disk drive assembly (e.g., spindle, motor, actuator).

One conventional base plate manufacturing process includes press working a sheet of metal with side frames mounted on opposing sides. In this process, a base plate is press worked to form a concave portion with a few holes for motor mounting. Two side frames are press worked from sheet metal and are fixedly mounted on the opposite sides of the base plate.

There are several disadvantages to this conventional process. For example, fixing the two side frames to the base plate is an additional assembly step that increases the cost of manufacturing. The side frames must be strictly controlled in the mounting position and the mounting strength. Another disadvantage is that relief surfaces for elements such as the disk, the actuator, the voice coil motor, the filter, and bosses or semi-pierces are not part of this process. Instead, all relief surfaces are generally formed as part of a machining operation. Additionally, oil and other residue that are used during the cold working operation must be removed by washing the finished base plate.

SUMMARY

A method is disclosed for forming a base plate that may be pressed worked by stamping the base plate with a progressive die assembly or a transfer die assembly. Other features and advantages of the present invention will be apparent from the accompanying drawings and from the detailed description that follows below.

BRIEF DESCRIPTION OF THE DRAWINGS

Embodiments of the present invention are illustrated by way of example, and not limitation, in the figures of the accompanying drawings in which:

FIGS. 1-26 illustrate one embodiment of a method for forming a base plate for a hard disk drive with a progressive die assembly.

FIGS. 28-54 illustrate one embodiment of a method for forming a hard disk drive base plate with a transfer die assembly.

DETAILED DESCRIPTION

Figure 10:
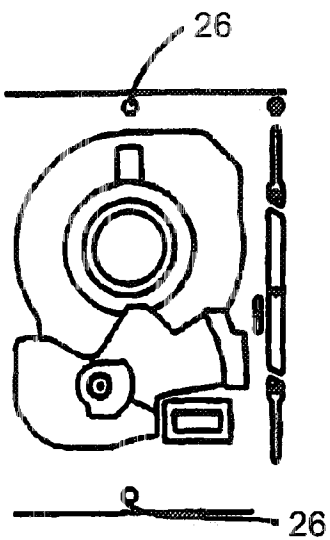

In one embodiment, a sheet of metal in strip form or coil form is stamped in a progressive die or a series of transfer dies in a sequence of press working operations. Press working operations include trimming, piercing, forging, stamping, bending, forming processes, coining, or other suitable processes. Coining relates to imprinting a shape of a face, an image, or a shape on a metal sheet. The metal used is typically an aluminum alloy such as aluminum 5052 in the form of a plate, coiled sheet circle, or other suitable form. In alternative embodiments, other suitable materials may also be used.

Within a progressive tool, one or more parts are formed with each stroke after being fed into the tool by a gripper or roll-feed system. The strip remains intact for transporting the parts from station to station. In a transfer die system, the raw material strip is the same as with the progressive system. However, at the first station, a blank is separated from the strip. Thereafter, it is fed through the stamping stations with the assistance of a gripper feed system. In general, a transfer die system involves freeing the part from the strip, and increasing the degree of freedom for the stamping and forming operation. In progressive dies systems, the feature cannot be implemented because the strip is needed for transportation from station to station.

Embodiments of a method for stamping a piece of metal are described herein with respect to forming a hard disk drive base plate. It may be appreciated, however, that stamping methods described herein may be used for forming other types of stamped parts.

FIGS. 1-26 illustrate one embodiment of a method for forming a base plate for a hard disk drive with a progressive die assembly. The progressive die assembly may include multiple stations aligned in a row, with a base plate part advanced from station to station by being attached to a scrap skeleton or carrier skeleton. Each station may include a stamping process to form a particular base plate element (e.g., boss, relief), a trimming stage, an idle stage, or other stages to form a hard disk drive base plate. In one embodiment, force for movement of the base plate through the progressive die assembly is applied by a roller feeder.

FIG. 1 illustrates stage 1 of the progressive die method in which a blank base plate 10 that ultimately becomes a hard disk drive base plate starts as a sheet of metal in coil form (not shown). The blank base plate 10 passes through a feeder (not shown) that advances the metal sheet into the progressive die assembly which may be guarded by a row of guide lifters (also not shown). The sheet of metal may be supported, for example, on a conveyor belt while the sheet of metal is fed into position such that a portion of the sheet metal is located between a top die portion and a bottom die portion for the first press working operation. Blank base plate 10 includes a scrap skeleton portion 11 that goes through each of the progressive die stations until it is parted off after the base plate 10 is formed completely. The edges of blank base plate 10 may include one or more pilot hole piercing(s) 12, as well as piercing hole openings 14 to allow blank base plate 10 to stretch and deform during the progressive die stamping process. Pilot hole piercing 12 and piercing hole openings 14 may be used to couple blank base plate 10 to the progressive die assembly. FIG. 2 illustrates stage 2 of the progressive die method, which is an idle stage that may be reserved for an additional process or insertion. For example, in one embodiment, this idle stage may be used to provide spacing for inserting a tooling device or interval between two stages/processes.

FIG. 3 illustrates stage 3 in which blank base plate 10 is advanced to the next station and a die presses into blank base plate 10 to form a voice coil motor relief surface 16, a motor sitting relief 18, and flex circuit opening relief 20. The blank base plate 10 is advanced until the blank base plate 10 is disposed between a top die portion above the blank base plate and a bottom die portion below the blank base plate (not shown). FIG. 4 illustrates a cross-sectional view of voice coil motor relief surface 16 taken along section A-A. FIG. 5 illustrates a cross-sectional view of flex circuit opening relief 20 taken along section B-B.

Figure 9:
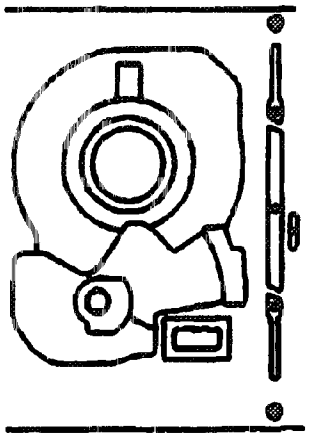
Figure 6:
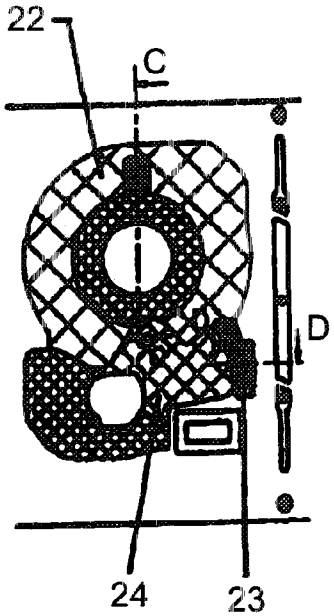
Figure 8:
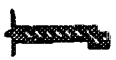
Figure 7:
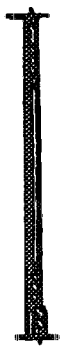
Figure 18:
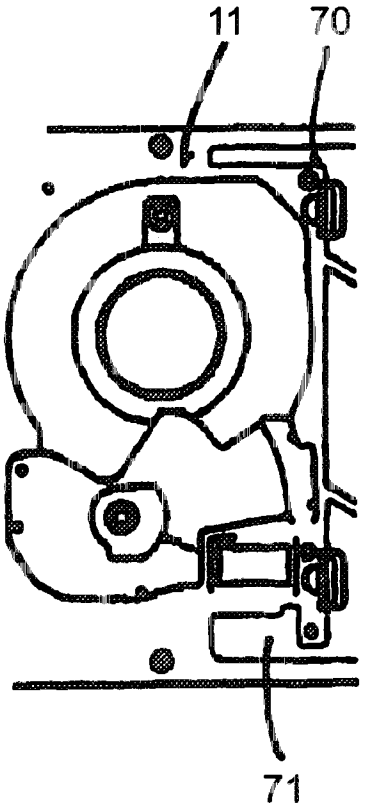
Figure 17:
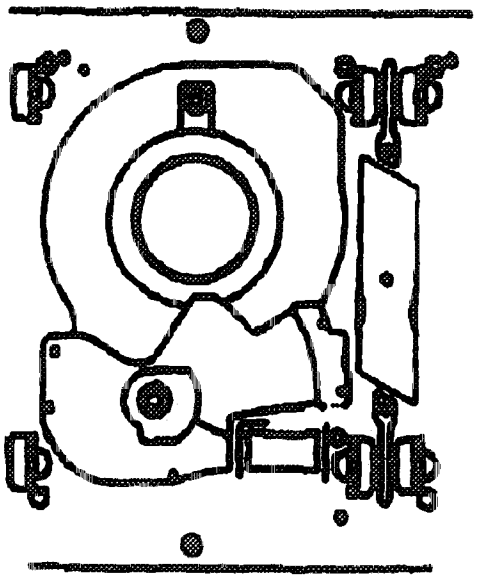

FIG. 6 illustrates stage 4 in which blank base plate 10, having already formed some parts of the base plate, is advanced to the next press working operation station to form a disk relief surface 22, an actuator relief surface 24. A rest area 23 is also formed near disk relief surface 22. Rest area 23 may serve as a "ramp load" for the magnetic heads of an actuator when not reading or writing on a disk substrate. FIG. 7 illustrates a cross-sectional view of disk relief surface 22 taken along section C-C. FIG. 9 illustrates a cross-sectional view of rest area 23 taken along section D-D. Forming disk relief surface 22 and actuator relief surface 24 causes material flow inward, therefore deformation may occur on the four sides of blank base plate 10. Blank base plate 10 is advanced from an idle Stage 5, FIG. 8, to Stage 6 as illustrated in FIG. 10. New pilot piercing holes 26 may be formed for improved locating and securing of blank base plate 10 during the progressive die method.

FIG. 11 illustrates stage 7 in which one or more bosses are formed up by cold forging. These bosses may include an actuator mount boss 28, voice coil motor mount boss 30, with or without mounting holes (not shown), a top cover locating boss 32, disk filter 34, and flex circuit mounting boss 36. FIG. 12 illustrates a cross-sectional view of flex circuit mounting 36 taken along line E-E, and FIG. 13 illustrates a cross-sectional view of disk filter 34 taken along line F-F.

FIG. 14 illustrates stage 8 in which additional bosses are formed near the bottom surface of blank base plate 10 by coining the metallic material downward. These additional bosses may include a printed circuit board (PCB) mounted boss 37 (with or without a mounting hole). One or more piercing bend reliefs 38 may also be formed. At stage 9, motor hub 40, flex circuit opening 42, piercing holes and bend relief 44 are formed as illustrated in FIG. 15. In one embodiment, excess material is trimmed from blank base plate 10 after these parts are formed. During trimming of blank base plate 10, excess metal is cut away from the base plate and prepared for side bending.

Figure 16:
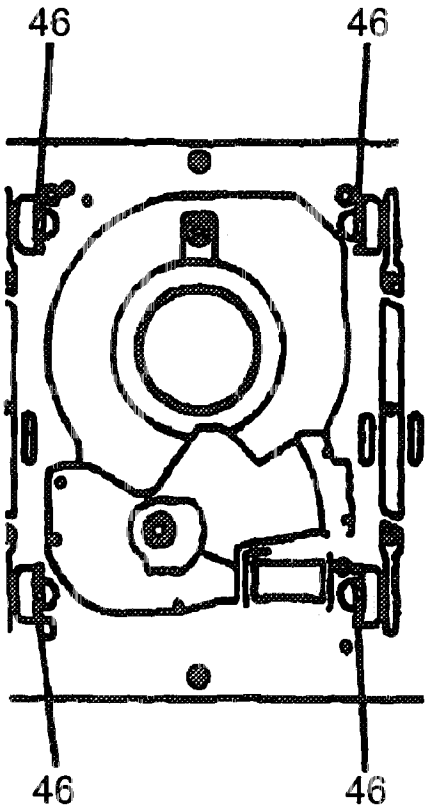
Figure 22:
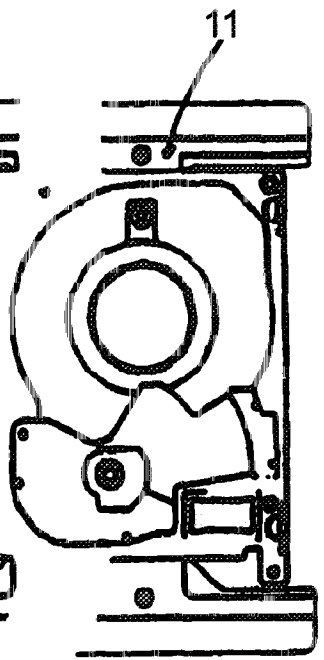
Figure 21:
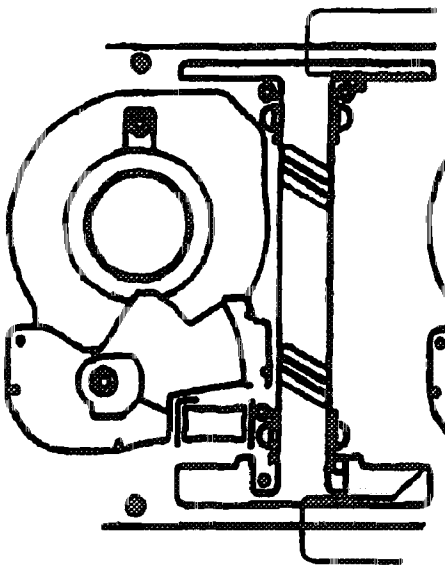
Figure 20:
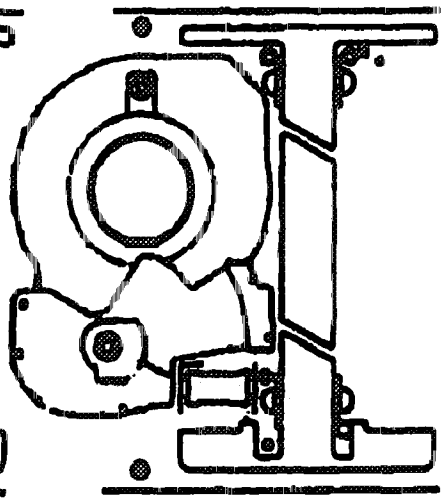
Figure 19:
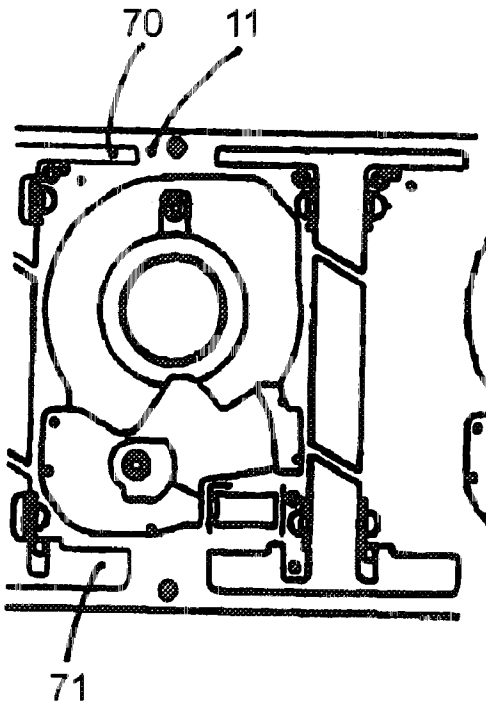
Figure 23:
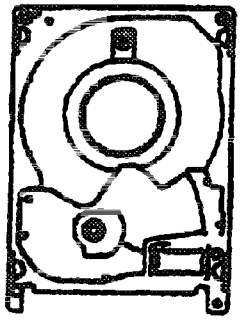
Figure 24:
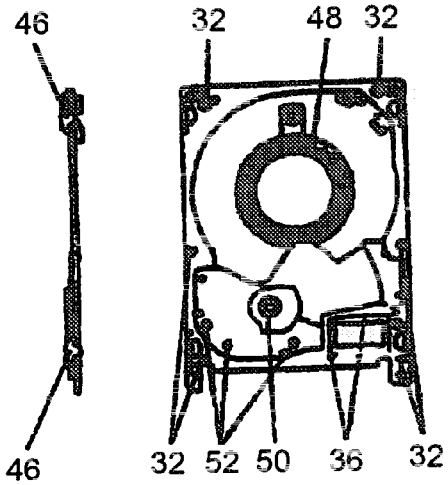

FIG. 16 illustrates stage 10 in which blank base plate 10 undergoes a press working operation for the L-bending of side frames 46 for the side mounting holes. The blank base plate 10 is then advanced to an idle Stage 11 (FIG. 17) and then to Stages 12 (FIG. 18) and 13 (FIG. 19). As illustrated, upper and lower portions 70, 71, respectively, of carrier skeleton 11 are removed with a trimming process to form the outer edges or profile of base plate 10. By the end of state 13, the rectangular-shaped profile of base plate 10 is defined. Base plate 10 undergoes a final trimming operation to size but is still attached to scrap skeleton 11.

In conventional base plate forming and piercing methods, the base plate is subjected to stress and strain that causes the plate to warp permanently from its flattened state. As such, at stage 14 illustrated in FIG. 20, base plate 10 undergoes a flattening process to maintain base plate 10 within a tolerance range for functional use. After an idle stage 15 illustrated in FIG. 21, base plate 10 is advanced to final trimming operation of stage 16 illustrated in FIG. 22. The scrap metal/carrier skeleton 11 is then separated from base plate 10 by a trimming punch, and base plate 10 is then air ejected from carrier skeleton 11.

After stage 16, in one embodiment, additional press procedures may be performed on base plate 10. During stages 17 and 18, illustrated by FIGS. 23 and 24, respectively, base plate 10 undergoes further machining methods to refine datums such as the motor sitting area 48, actuator sitting area 50, voice coil motor (VCM) sitting area 52, top cover mounting area 32, and flex circuit mounting area 36, because some tolerances cannot be achieved by stamping process alone. Whether these surfaces require machined processes may be determine by the particular function of the base plate. Dimensional tolerances may be achieved by machining processes is within about ±0.02 mm.

Figure 25:
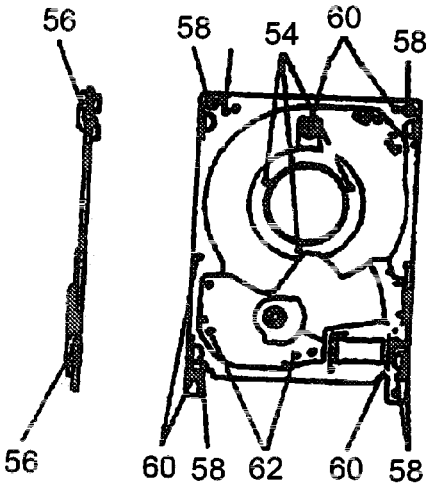
Figure 26:
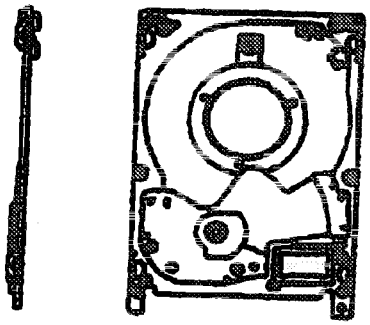

The base plate is advanced to stage 19 illustrated by FIG. 25, which is the last machining operation in which holes in the base plate 10 are formed by drilling and tapping. The holes include the VCM mounting holes 54, left and right mounting holes 56, top cover mounting holes 58, PCB mounting holes 60, and damper mounting holes 62. Base plate 10 may undergo a surface treatment to clean off any residual dirt and in an alternative embodiment, a surface coating/finishing (e.g., E-coating and Electroless Nickel Plating) may be applied to base plate 10 in stage 20 as illustrated by FIG. 26.

Figure 27:
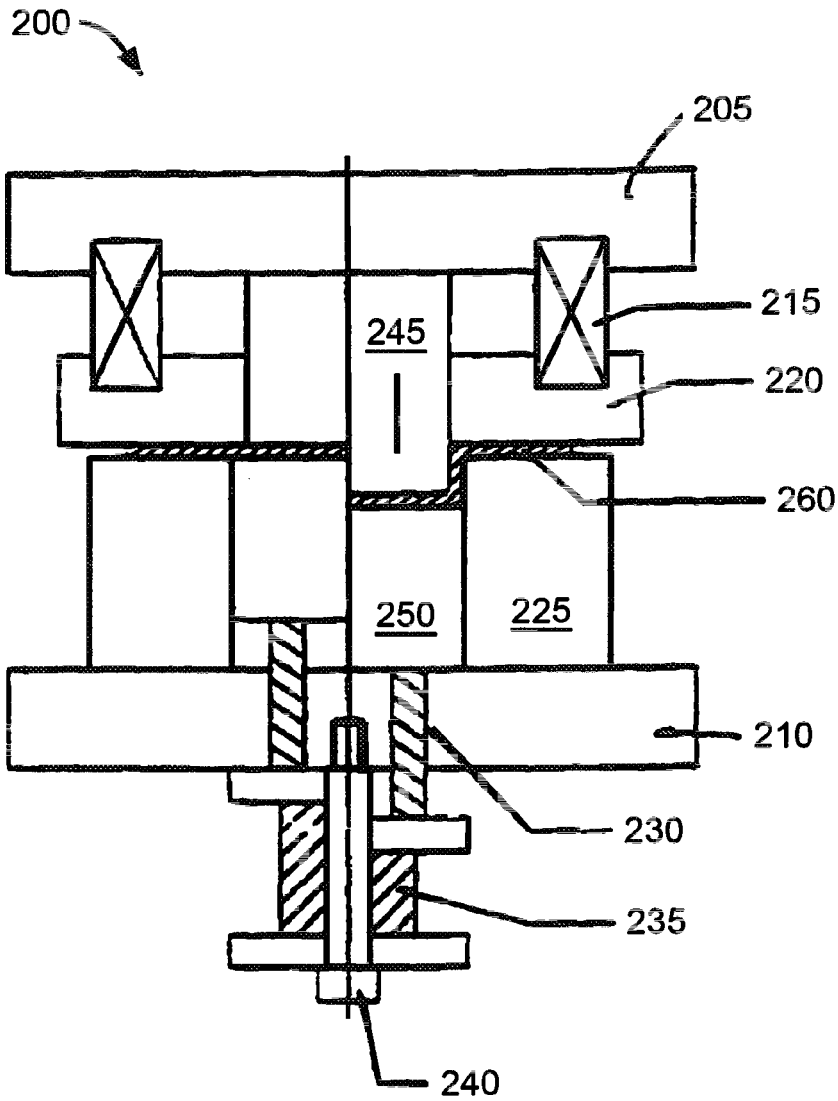
FIG. 27 illustrates a cross-sectional view of one embodiment of a transfer die tool that may be used for press working a base plate.

In another embodiment, a transfer die assembly, that includes a series of transfer dies, may be used for press working a blank base plate for the formation of a hard disk drive base plate. FIG. 27 illustrates a cross-sectional view of one embodiment of a transfer die tool 200 that may be used for press working a base plate. Die tool 200 includes a top portion having an upper shoe 202 coupled to a stripper 220 by spring 215. A bottom portion of die tool 200 includes lower shoe 210 and a die portion 225 that extends toward stripper 220. Transfer punch 230 extends through lower shoe 210 and shedder 250 is disposed above lower shoe 210. Spring 235 and shoulder screw 240 are disposed below lower shoe 210. Upper punch 245 extends downward from upper shoe 205 and extends through stripper 220. A workpiece 260 (e.g., a blank base plate) is disposed between upper shoe 205 and lower shoe 210 with upper punch 245 and shedder 250 making contact with workpiece 260 during a press working operation.

Figure 28:
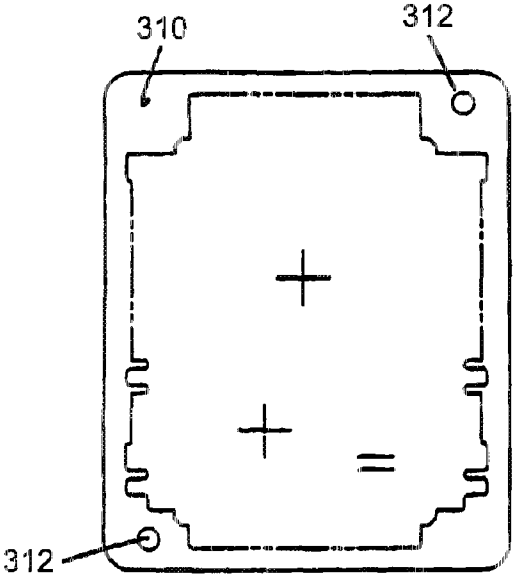

FIGS. 28-54 illustrate one embodiment of a method for forming a hard disk drive base plate with a transfer die assembly. In stage 1 of the first press working operation illustrated in FIG. 28, a blank base plate 310 is provided. The material used is typically an aluminum alloy such as aluminum 5052 or 6061 in the form of a plate, coiled sheet, or other suitable form. For rigidity purposes, the thickness of the material for blank base plate 310 may be from about 1.50 mm to about 2.50 mm. Selection of material thickness may depend on a particular product design. The edges of blank base plate 310 may include one or more pilot hole piercing(s) 312, to allow blank base plate 310 to stretch and deform during the transfer die method. Pilot hole piercing 312 may be used to couple blank base plate 310 to the transfer die assembly.

Figure 29:
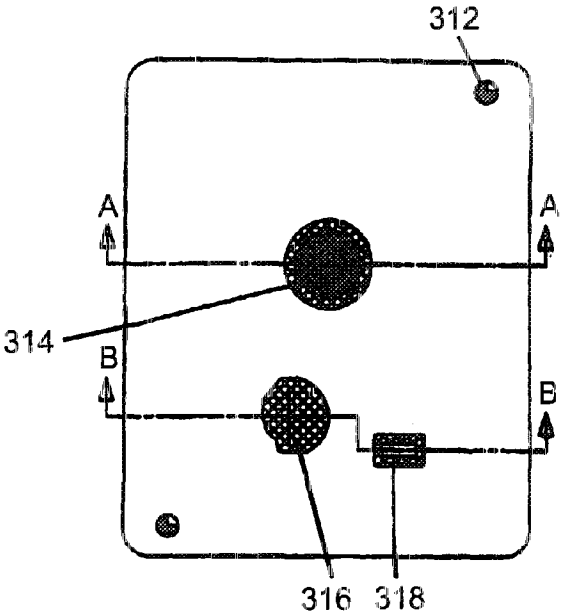
Figure 31:
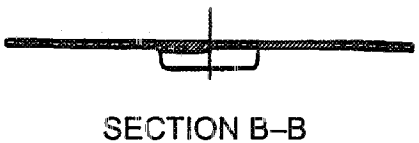
Figure 30:
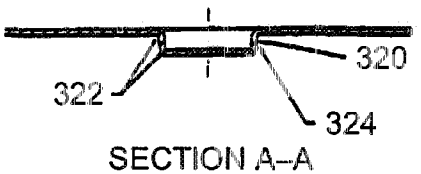

The blank base plate is advanced to next station, station 2, illustrated in FIG. 29. A die press (e.g., press 200) stamps the blank base plate 310 to form a motor hub 314, a voice coil motor relief surface 316, and flex circuit opening relief 318. FIG. 30 illustrates a cross-sectional view of motor hub 314 taken along line A-A. The stresses and strains produced in the sheet material vary from the different die presses in the transfer die assembly. As a result, the side wall thickness 320 may be thinner than an original blank base plate thickness. In one embodiment, the maximum tolerance for forming blank base plate 310 in diameter or depth of relief control is within about ±0.08 mm. Punch and die radius 322 are permissible at corner of the motor hub 314 to prevent cup tearing and a draft angle 324 around side wall 320. FIG. 31 illustrates a cross-sectional view of voice coil motor relief surface 316 and flex circuit opening relief 318 taken along line B-B.

Figure 32:
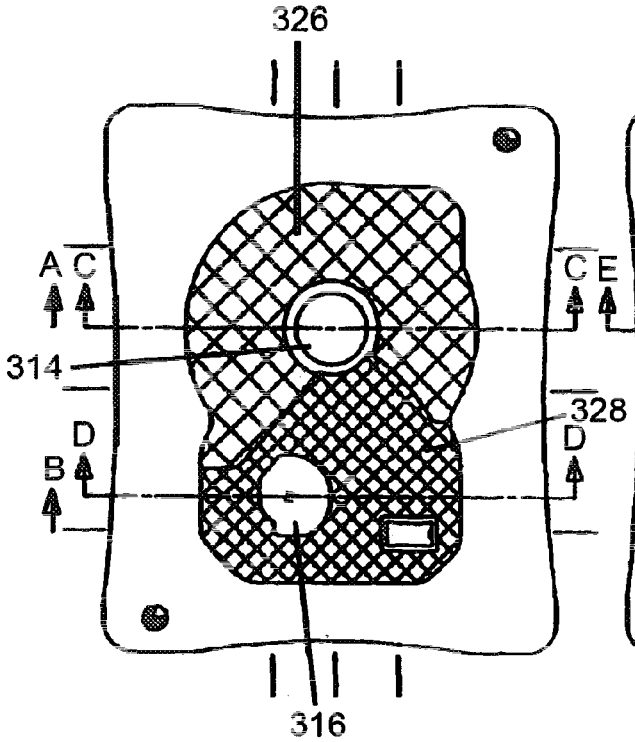
Figure 33:
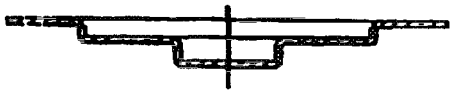
Figure 34:
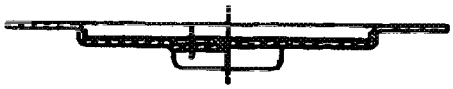

FIG. 32 illustrates stage 3 of the transfer die method in which blank base plate 310 is advanced to the next station to form disk relief surface 326 and actuator relief surface 328. FIG. 32 also illustrates the deformation on four sides of the blank base plate 310 because of the material flow inward during the forming of the relief surfaces (e.g., disk relief surface 326, actuator relief surface 328). FIG. 33 illustrates a cross-sectional view of motor hub 314 and disk relief surface 326 after formation taken along line C-C. FIG. 34 illustrates a cross-sectional view of actuator relief surface 328 taken along line D-D. In one embodiment, dimensional tolerance of forming depth may be within about ±0.10 mm.

Figure 35:
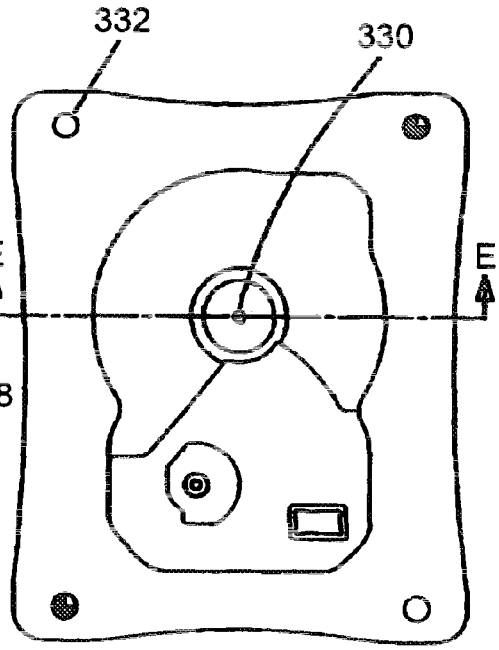
Figure 36:
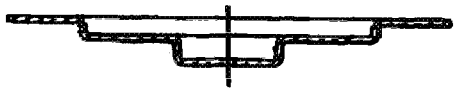

FIG. 35 illustrates stage 4 in which a motor hub hole 330 is formed as well as additional pilot piercing hole(s) 332. New pilot piercing holes 332 may be required for better locating purpose as the blank base plate 310 may become deformed after forming the various relief surfaces and holes. FIG. 36 illustrates a cross-sectional view of motor hub 314 and disk relief surface 326 after formation of hole 330 taken along line E-E.

Figure 37:
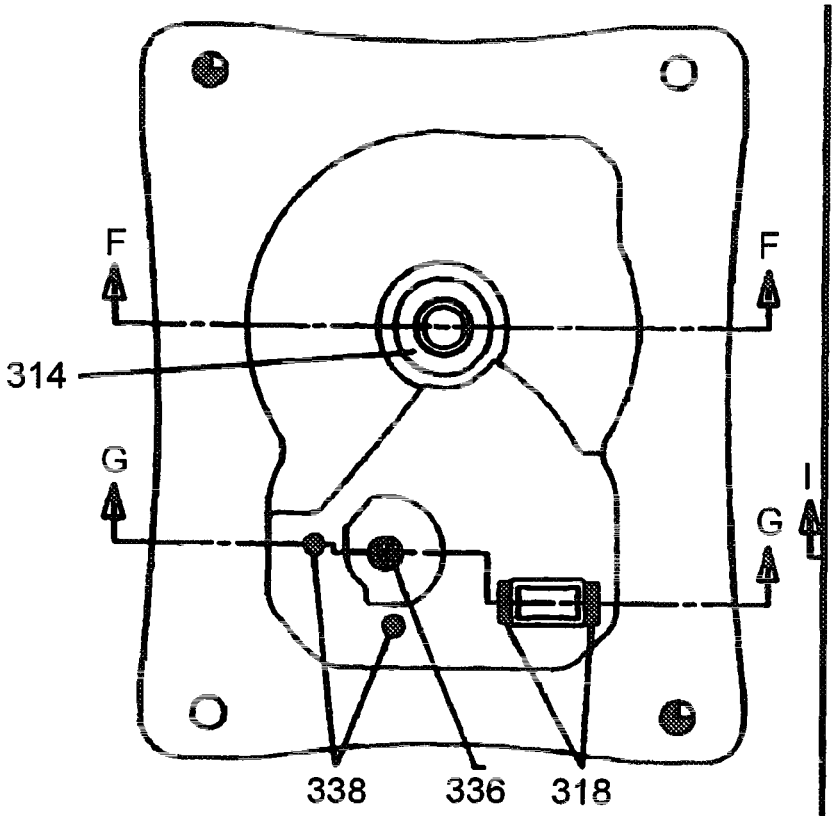
Figure 38:
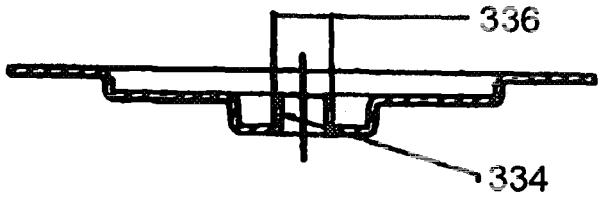
Figure 39:
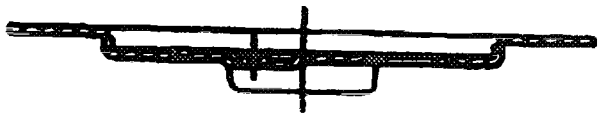

FIG. 37 illustrates stage 5 of the transfer die method in which blank base plate 310 is advanced to the next station for forming motor shaft and bosses. The metal sheet placed in a die (e.g., die 200) is pressed with a punch (e.g., punch 245) forcing the metal out through the punch opening or the gap between the die and the punch. Therefore the side wall thickness 334 will be thinner then the original blank and is about 60% to about 75% of the original blank thickness. The dimensional tolerance for the motor shaft diameter 336 is within about ±0.08 mm. FIG. 38 illustrates a cross-sectional view taken along line F-F of motor hub 314 and FIG. 39 illustrates a cross-sectional view taken along line G-G of the actuator pivot bearing boss 336, a voice coil motor mount boss 338, and flex circuit mounting 318. The height of the bosses may be controlled within about ±0.10 mm.

FIG. 40 illustrates stage 6 in which press work on blank base plate 310 continues with forming and cold forging process. Additional bosses are formed which including Z datum 338 and PCB mount bosses 340 (shown in FIG. 43). A disk filter 342 and an actuator stopper pin 344 are formed by forging. The height of disk filter 342 and actuator stopper pin 344 are about 2.5 times a material thickness. FIG. 41 illustrates a cross-sectional view taken along line H-H of disk filter 342 and FIG. 42 illustrates a cross-sectional view taken along line I-I of actuator stopper pin 344.

Figure 43:
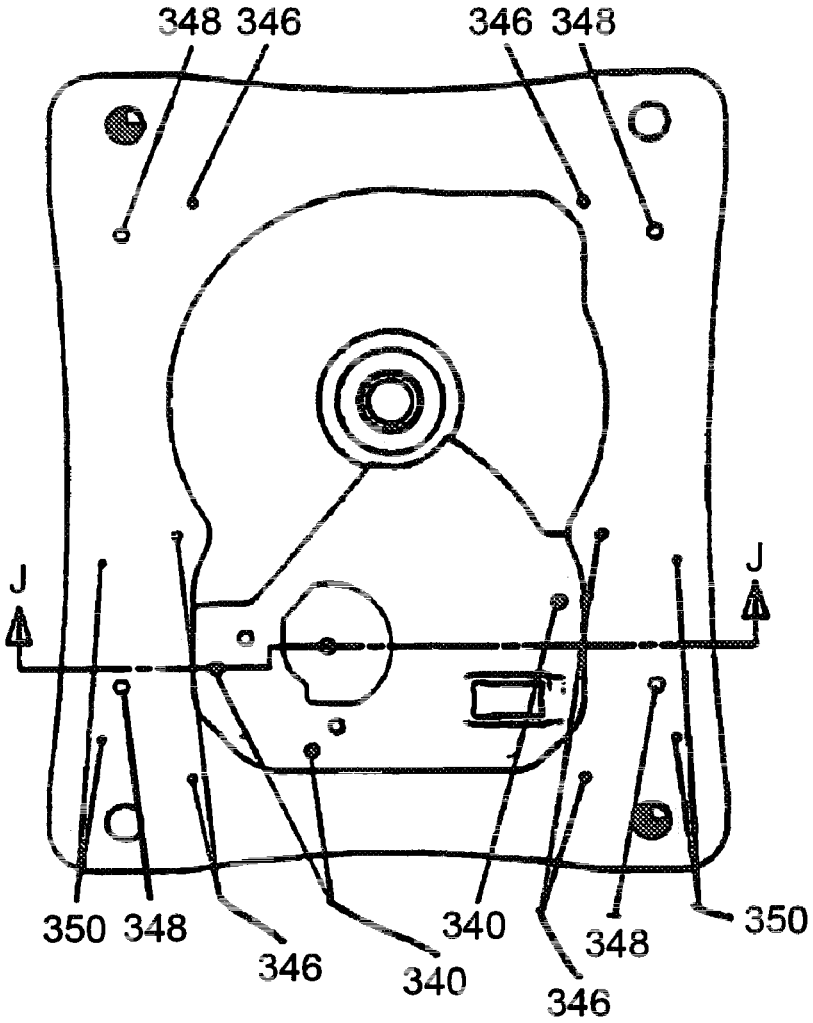
Figure 44:
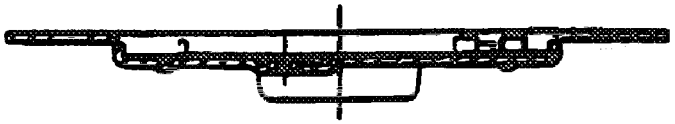

FIG. 43 illustrates stage 7 in which base plate 310 is advanced to the next station for hole piercing and semi-pierce operation. The hole size of a piercing is determined by a minimum ratio of about 70% against material thickness. The holes include the top cover mounting holes 346, left and right mounting holes 348, damper mounting holes 350, and PCB mount boss 340. FIG. 44 illustrates a cross-sectional view taken along line J-J of PCB mount boss 340.

Figure 47:
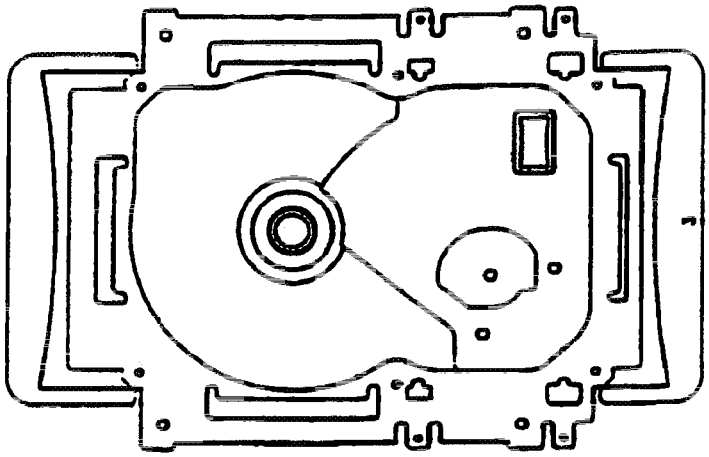
Figure 46:
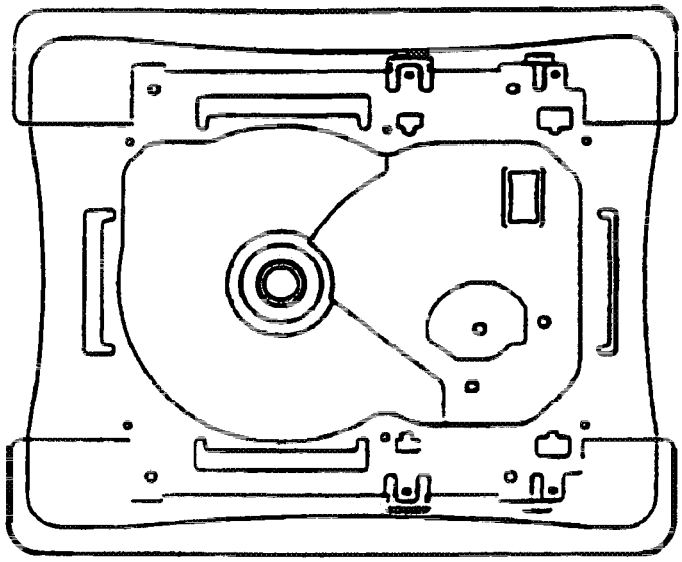
Figure 45:
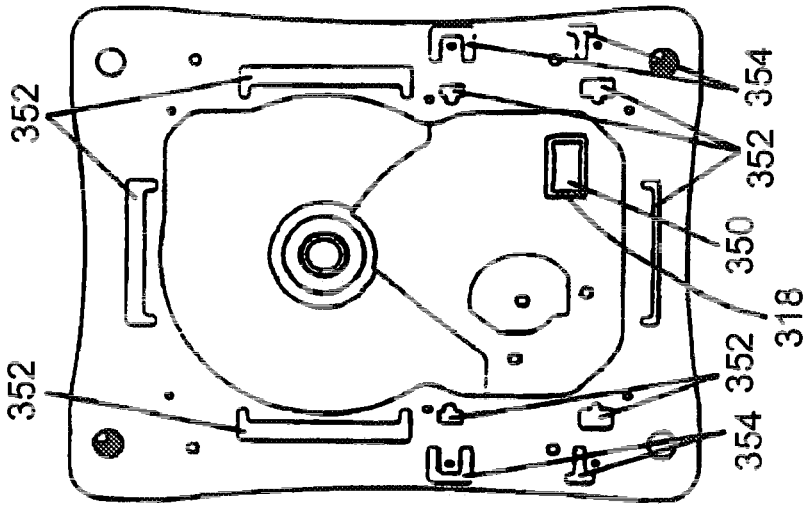

FIG. 45 illustrates stage 8 in which base plate 310 undergoes a trimming procedure to remove material near an opening of flex circuit opening 318 as well as near piercing bend relief (352, 354). FIG. 46 and FIG. 47 illustrate stage 9 and stage 10, respectively, in which base plate 310 is advanced to die stations for profile trimming operations. The final outline of base plate 310 is completed in stage 10. In conventional base plate forming and piercing methods, the base plate is subjected to stress and strain that causes the plate to warp permanently from its flattened state. As such, at stage 11 illustrated in FIG. 48, base plate 310 undergoes a flattening process to maintain base plate 310 within a tolerance range for functional use.

Figure 50:
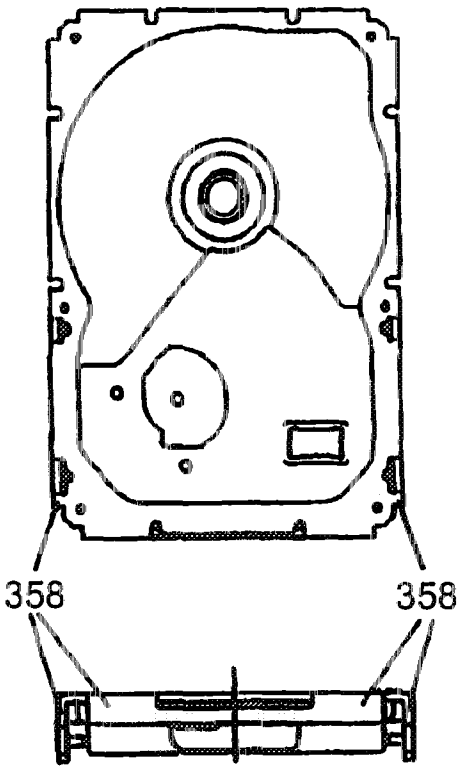
Figure 49:
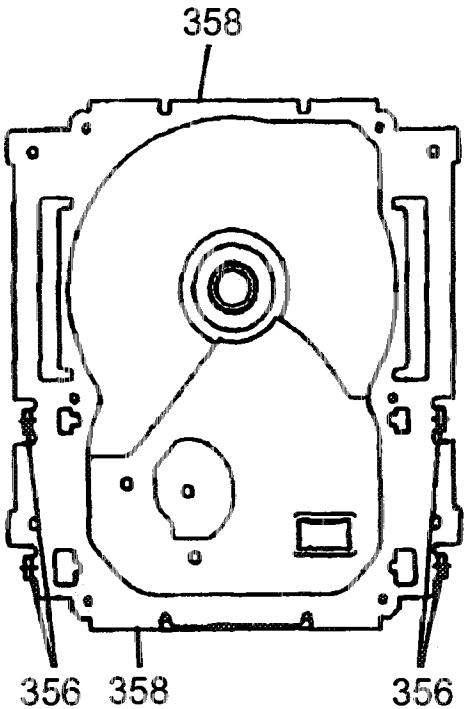
Figure 48:
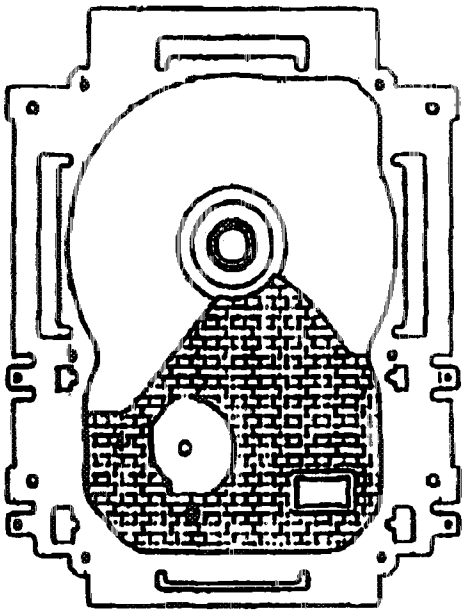

FIG. 49 and FIG. 50 illustrate stage 12 and stage 13, respectively, in which base plate 310 then undergoes an L-bending process. This process may include the bending of damper mounting bracket 356 and four side frames 358 formed by bending a portion of the sheet metal that makes up base plate 310 to about 90°.

Figure 51:
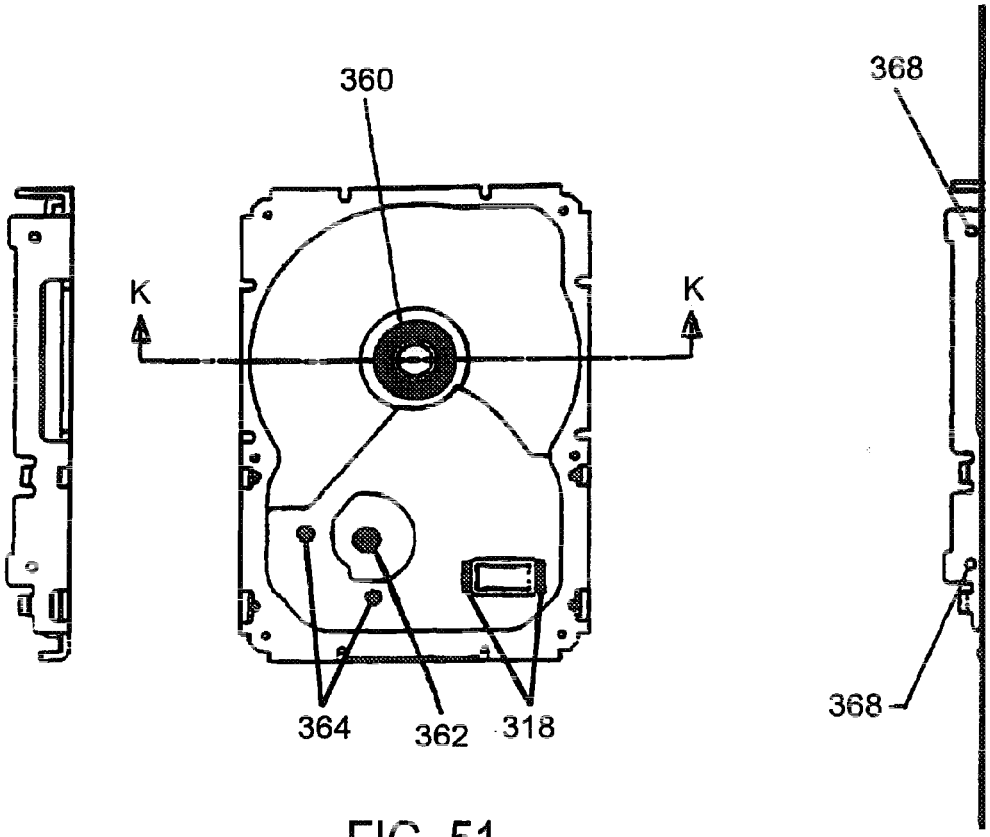
Figure 52:
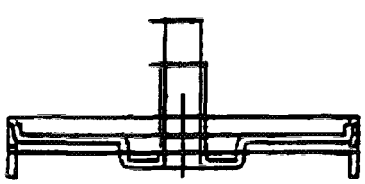

FIG. 51 illustrates stage 14 in which, in one embodiment, the base plate 310 is then machined to refine datums such as the motor sitting area 360, actuator sitting area 362, voice coil motor (VCM) sitting area 364, and flex circuit mounting area 318, in situations where some tolerances are unable to be achieved by a stamping process alone. Whether these surfaces require machine procedures may be determine by the function of the base plate. Dimensional tolerances may be achieved by machining processes is within about ±0.02 mm. FIG. 52 illustrates a cross-sectional view of motor sitting area 360 taken along line K-K. It may be appreciated that machining of datum is not necessarily required for forming a completed base plate.

Figure 53:
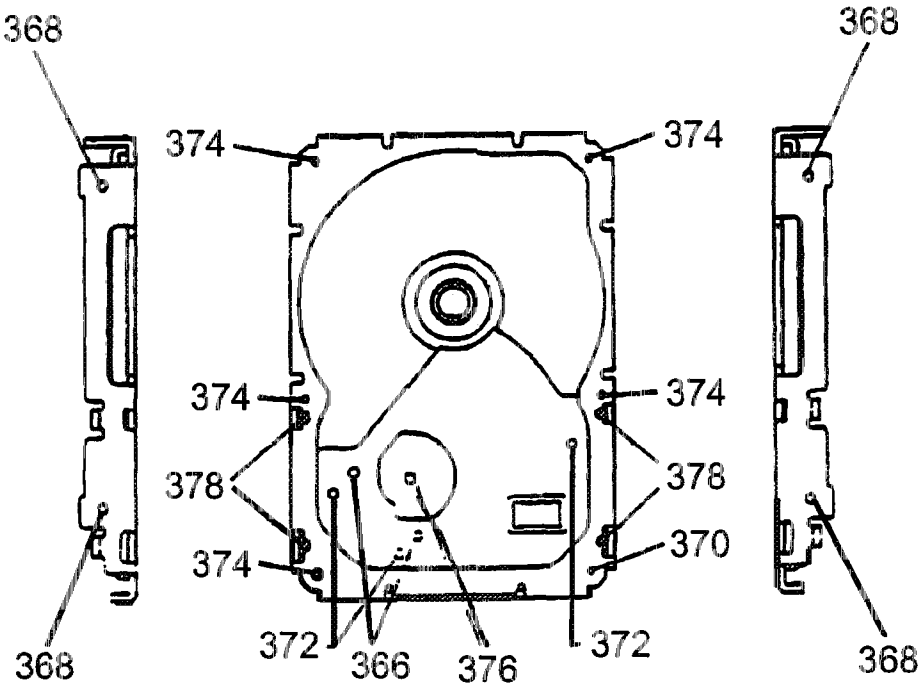

FIG. 53 illustrates stage 15 in which base plate 310 is advanced to the last machining stage for drilling and tapping where holes in the base plate are pierced in previous operation. The holes includes VCM mounting holes 366, left and right mounting holes 368, top cover mounting holes 370, PCB mounting holes 372, actuator pivot hole 374, and damper mounting holes 376.

Figure 54:
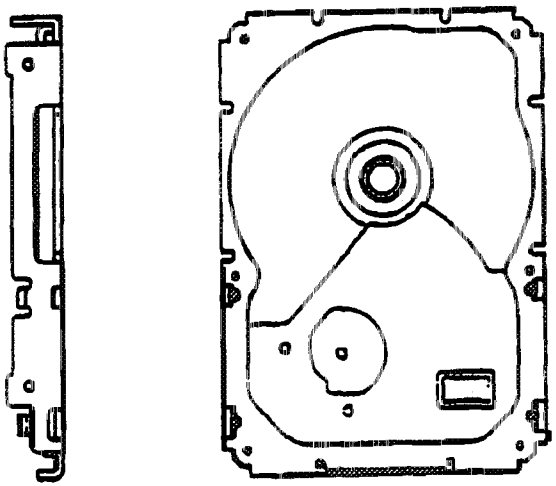

In the final stage illustrated in FIG. 54, base plate 310 undergoes a surface treatment to clean off any residual dirt and if required, and in an alternative embodiment, a surface coating/finishing may be applied to base plate 310 (e.g., E-coating and Electroless Nickel Plating).

Figure 55:
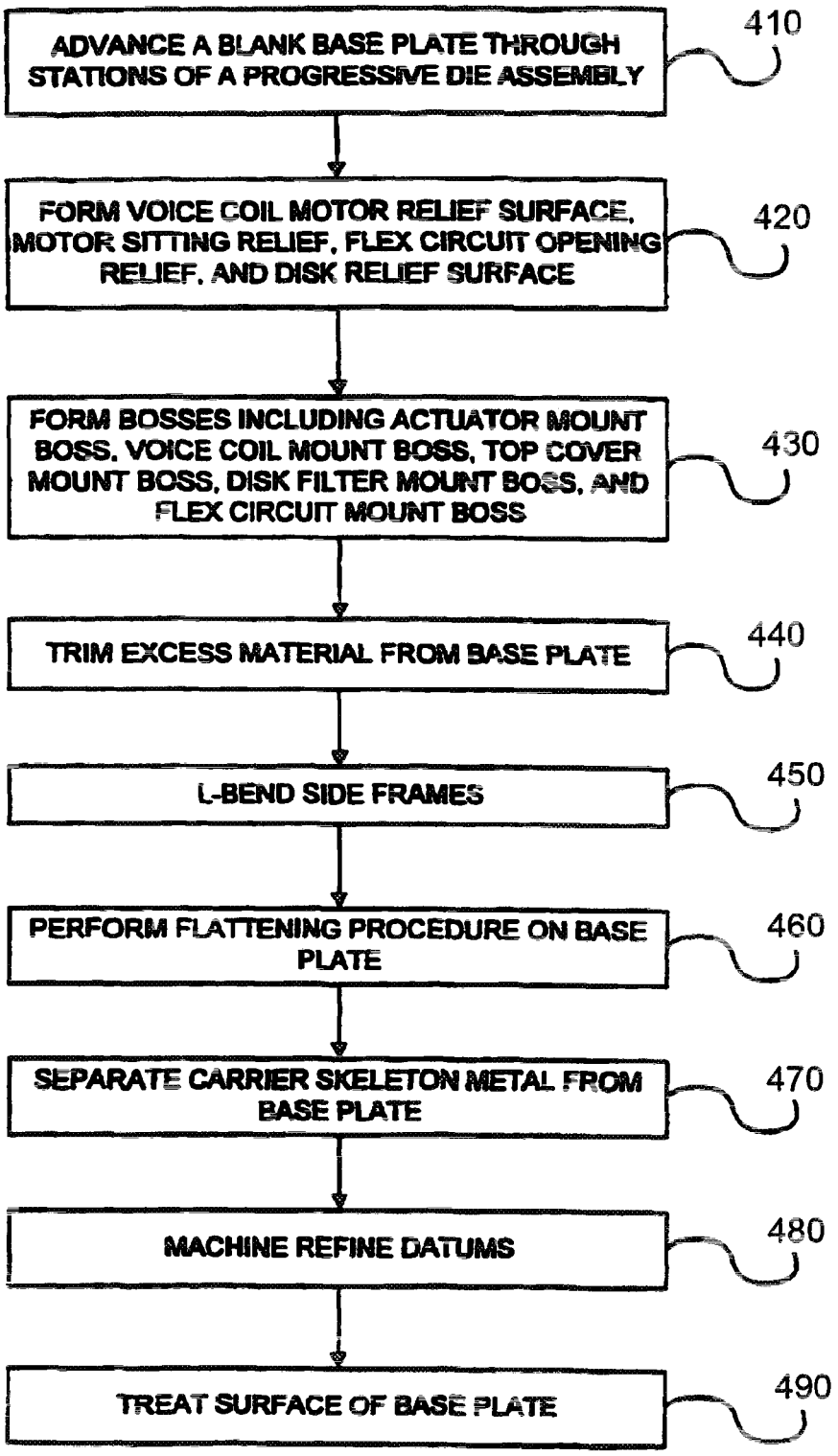
FIG. 55 illustrates a block diagram of one method forming a hard disk drive base plate with a progressive die assembly.

FIG. 55 illustrates a block diagram of one method forming a hard disk drive base plate with a progressive die assembly. The progressive die assembly may include multiple stations aligned in a row, with base plate part advanced from station to station, block 410. In one embodiment, the progressive die includes a progressive stamping press work operation. A sheet of metal in strip form or coil form is stamped in a progressive die in a sequence of press working operations. Press working operations include trimming, piercing, forging, stamping, bending, forming processes, coining, or other suitable processes. In one embodiment, a blank base plate portion (e.g., base plate 10) is attached to a piece of scrap metal (e.g., carrier skeleton 11) while undergoing various stamping/press procedures of the progressive die assembly. The blank base plate is advanced to the next station in which a die presses into blank base plate to form a voice coil motor relief surface (e.g., 16), a motor sitting relief (e.g., 18), flex circuit opening relief (e.g., 20), and disk relief surface (e.g., 22), block 420.

The base plate is advanced to the next station in which one or more bosses are formed up by cold forging including an actuator mount bass (e.g., 28), a voice coil motor mount bass (e.g., 30), a top cover locating boss (e.g., 32), a disk filter mount boss (e.g., 34), and a flex circuit mount boss (e.g., 36), block 430. In one embodiment, excess material is trimmed from blank base plate after the bosses are formed, block 440. The base plate then undergoes a press working operation for the L-bending of side frames (e.g., 46) for the side mounting holes, block 450. In one embodiment, the base plate may be subjected to a flattening process to maintain the base plate within a tolerance range for functional use, because the base plate may warp during some of the pressing/stamping procedures, block 460. The scrap skeleton is then parting off by a trimming punch and base plate 10 is then air ejected from the scrap skeleton. The scrap metal/carrier skeleton is then separated from the base plate, block 470. In one embodiment, separation is accomplished by a trimming punch followed by the base plate being air ejected from the scrap skeleton.

In one embodiment, the base plate may undergo further machining methods to refine datums such as a motor sitting area (e.g., 48), an actuator sitting area (e.g., 50), and a voice coil motor sitting area (e.g., 52), block 480. Lastly, the surface of the base plate may be treated to clean off any residual dirt and in an alternative embodiment, a surface coating/finishing may be applied to the base plate (e.g., E-coating and Electroless Nickel Plating), block 490.

Figure 56:
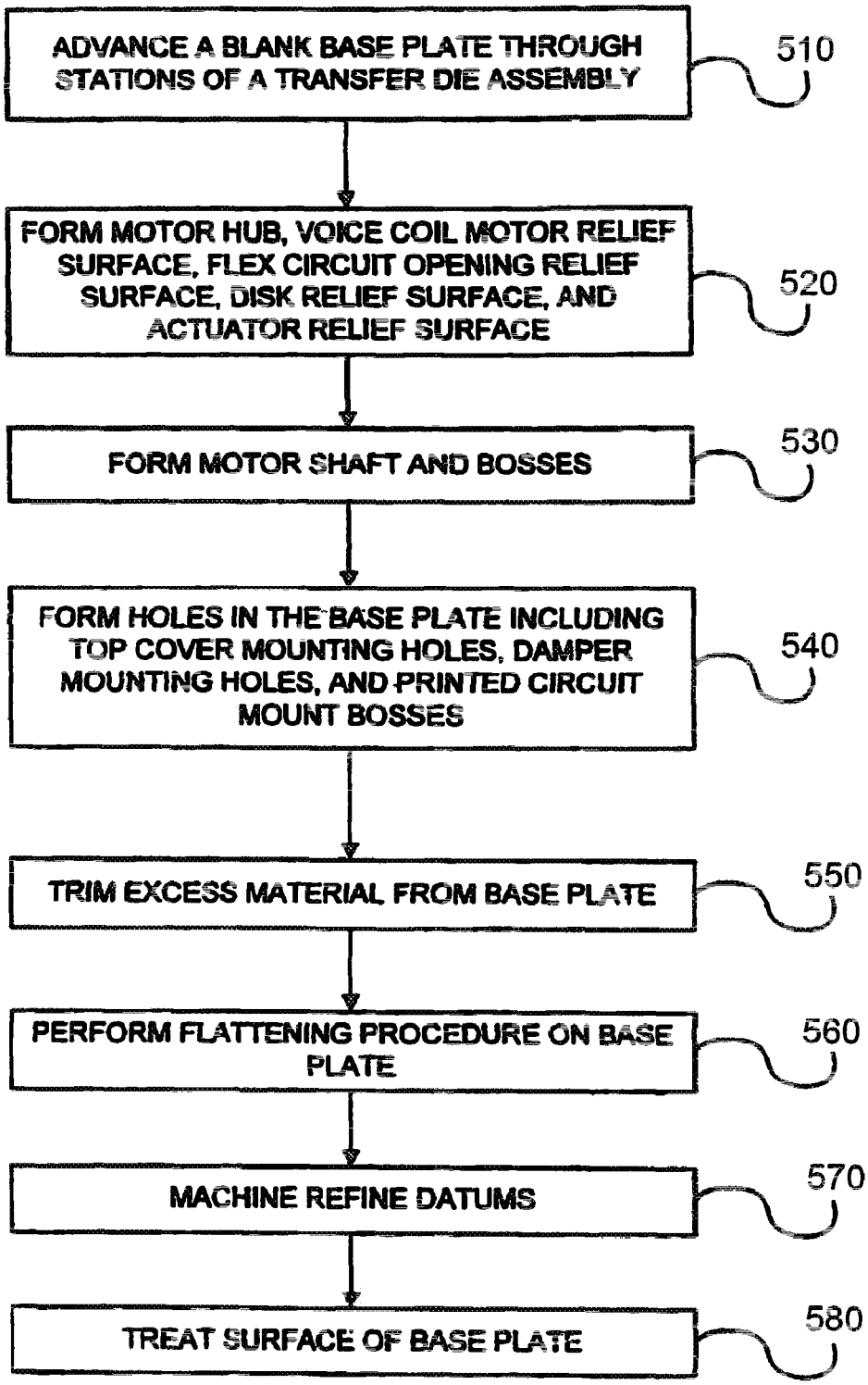
FIG. 56 illustrates a block diagram of one method forming a hard disk drive base plate with a transfer die assembly.

FIG. 56 illustrates a block diagram of one method forming a hard disk drive base plate with a transfer die assembly. In one embodiment, a sheet of metal in strip form or coil form is stamped in a series of transfer dies in a sequence of press working operations. Press working operations include trimming, piercing, forging, stamping, bending, forming processes, coining, or other suitable processes. A blank base plate (e.g., 310) is provided from the metal sheet that is advanced through stations of the transfer die assembly, block 510. In one embodiment, the material for the base plate may be an aluminum alloy such as aluminum 5052 or 6061.

The blank base plate is advanced to a die stamping station (e.g., press 200) to form a motor hub (e.g., 314), a voice coil motor relief surface (e.g., 316), and a flex circuit opening relief (e.g., 318), disk relief surface (e.g., 326), and an actuator relief surface (e.g., 328), block 520 followed by the formation of a motor shaft and bosses, block 530. At another die station, the base plate may be stamped to form top cover mounting holes (e.g., 346), damper mounting holes (e.g., 350), and a PCB mount boss (e.g., 340), block 540. In one embodiment, the base plate may undergo a trimming procedure to remove excess material (e.g., near an opening of flex circuit opening, as well as near piercing bend relief), block 550, followed by a flattening process to maintain the base plate within a tolerance range for functional use, block 560.

In one embodiment, the base plate may undergo further machining methods to refine datums such as a motor sitting area (e.g., 360), an actuator sitting area (e.g., 362), and a voice coil motor sitting area (e.g., 364), block 570. Lastly, the surface of the base plate may be treated to clean off any residual dirt and in an alternative embodiment, a surface coating/finishing may be applied to the base plate (e.g., E-coating and Electroless Nickel Plating), block 580.

In the foregoing specification, the invention is described with reference to specific embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A method comprising:

advancing a blank base plate through a plurality of die stations; and press working parts of the blank base plate at each of the plurality of die stations to form a disk drive base plate, wherein the press working comprises stamping the blank base plate through each of the plurality of die stations of a transfer die assembly, and forming a motor hub, a voice coil motor relief surface, a flex circuit opening relief surface, a disk relief surface at least partially surrounding the motor hub, and an actuator relief surface at least partially surrounding the voice coil motor relief surface.

2. The method of claim 1, wherein press working further comprises forming a motor shaft and bosses.

3. The method of claim 2, wherein press working further comprises forming a top cover mounting hole, a damper mounting hole, and printed circuit board bosses.

4. The method of claim 3, further comprising:

trimming excess material from the base plate; and flattening the base plate.

5. The method of claim 4, further comprising machine refining datums on the blank base plate.

6. The method of claim 5, further comprising cleaning a surface of the blank base plate.

7. A method, comprising:

advancing a blank base plate through a transfer die having a plurality of die stations; and stamping the blank base plate at each of the plurality of die station to form a disk drive base plate, wherein the stamping comprises forming a motor hub, a voice coil motor relief surface, a flex circuit opening relief surface, a disk relief surface at least partially surrounding the motor hub, and an actuator relief surface at least partially surrounding the voice coil motor relief surface.

8. The method of claim 7, wherein stamping further comprises press working the blank base plate.

9. The method of claim 8, wherein stamping further comprises forming a motor shaft and bosses.

10. The method of claim 8, wherein stamping further comprises forming a top cover mounting hole, a damper mounting hole, and printed circuit board bosses.

11. The method of claim 7, further comprising:

trimming excess material from the base plate; and flattening the base plate.

12. The method of claim 7, further comprising machine refining datums on the blank base plate.

13. The method of claim 12, further comprising cleaning a surface of the blank base plate.

* * * * *